US010378699B2

(12) United States Patent
Musser et al.

(10) Patent No.: US 10,378,699 B2
(45) Date of Patent: Aug. 13, 2019

(54) LIGHT PANEL RETRO-FIT KITS

(71) Applicant: Flex Ltd., Singapore (SG)

(72) Inventors: Jordon Musser, Dallas, TX (US); Chris Stratas, Burlingame, CA (US)

(73) Assignee: Flex Ltd, Singapore (SG)

( * ) Notice: Subject to any disclaimer, the term of this patent is extended or adjusted under 35 U.S.C. 154(b) by 0 days.

(21) Appl. No.: 15/687,045

(22) Filed: Aug. 25, 2017

(65) Prior Publication Data

US 2018/0073687 A1 Mar. 15, 2018

Related U.S. Application Data

(60) Provisional application No. 62/385,564, filed on Sep. 9, 2016.

(51) Int. Cl.

| | |
|---|---|
| ***F21K 9/275*** | (2016.01) |
| ***F21S 8/02*** | (2006.01) |
| ***F21V 21/04*** | (2006.01) |
| ***F21V 23/00*** | (2015.01) |
| ***F21K 9/278*** | (2016.01) |
| ***F21V 3/00*** | (2015.01) |
| ***F21V 17/10*** | (2006.01) |
| *F21Y 105/16* | (2016.01) |
| *F21Y 115/10* | (2016.01) |
| *F21Y 109/00* | (2016.01) |

(52) U.S. Cl.

CPC ..... *F21K 9/275* (2016.08); *F21K 9/278* (2016.08); *F21S 8/026* (2013.01); *F21V 3/00* (2013.01); *F21V 17/105* (2013.01); *F21V 21/04* (2013.01); *F21V 23/003* (2013.01); *F21Y 2105/16* (2016.08); *F21Y 2109/00* (2016.08); *F21Y 2115/10* (2016.08)

(58) Field of Classification Search

USPC ..... 362/235

See application file for complete search history.

(56) References Cited

U.S. PATENT DOCUMENTS

| | | | | |
|---|---|---|---|---|
| 9,279,553 | B1 * | 3/2016 | Scribante | F21S 8/026 |
| 2013/0027915 | A1 | 1/2013 | Caferro et al. | |
| 2015/0267873 | A1 | 9/2015 | Price et al. | |
| 2016/0356430 | A1 | 12/2016 | Stratas et al. | |

OTHER PUBLICATIONS

Extended European Search Report issued in corresponding application No. 17189660.8 dated Dec. 12, 2017.

* cited by examiner

*Primary Examiner* — Rafferty D Kelly

(74) *Attorney, Agent, or Firm* — Weber Rosselli & Cannon LLP

(57) ABSTRACT

The present disclosure is directed to a lighting retro-fit assembly including a panel configured for the passage of light therethrough, at least one light emitting diode (LED) secured to the panel, a driver electrically connected to the at least one LED, and an extendible suspension device, where the extendible suspension device permits mechanical connection of the panel to an existing lighting structure while enabling access to the driver.

18 Claims, 5 Drawing Sheets

LIGHT PANEL RETRO-FIT KITS

BACKGROUND

1. Technical Field

The present disclosure relates to light panels and, more specifically, to light panel kits to retro-fit light panels into ceilings having existing lighting structures, such as fluorescent lighting.

2. Discussion of Related Art

Fluorescent lights used in many industrial applications may include troffers fitted into drop ceiling grids to provide illumination to work spaces. In some cases, ductwork is implemented above the ceiling grids, and the troffers may be configured to seal a duct making up part of the ductwork. Depending on the age of the building, the ducts above the troffers may contain hazardous materials that preferably are to be left undisturbed.

Current technology is just to continue replacing lamps as they are used and occasionally replace the ballasts, starters and other components as they wear and are no longer viable. As can be readily understood by those experienced in this field, replacement of the ballasts, which are often mounted on the back of the troffer, or otherwise enclosed within the troffer in trim pieces, can be a time consuming operation, requiring the securing of all lights on a given circuit before the replacement can be undertaken. Even once commenced each ballast will require, for example in a two lamp parallel ballast scenario, five separate electrical connections as well as mechanically securing the ballast to the troffer, and then return of all of the trim pieces or reattachment of the troffer entirely. In addition to these inefficiencies, fluorescent lighting has been superseded by light emitting diodes (LEDs) in terms of efficiency, cost, maintenance and even light quality. Accordingly, there is a need to take advantage of this improvement in basic lighting technology and address the shortcomings described above.

SUMMARY

The present disclosure is directed to a lighting retro-fit assembly including a panel configured for the passage of light therethrough, at least one light emitting diode (LED) secured to the panel, a driver electrically connected to the at least one LED, and an extendible suspension device, where the extendible suspension device permits mechanical connection of the panel to an existing lighting structure while enabling access to the driver.

The lighting retro-fit assembly may include at least one alignment block. Further, the extendible suspension device includes a magnet and a spring, and the panel may formed of two sheets of material, where the at least one LED is secured to a top sheet of the two sheets of material such that light produced is projected through a bottom sheet of the two sheets of material.

The panel may include a flexible trim piece that deforms elastically to enable insertion of the flexible trim piece between a troffer flange of a troffer and a T-track, the trim piece having sufficient rigidity to support the panel following installation.

Alternatively, the lighting retro-fit assembly may include a trim piece where the panel rests on the trim piece upon installation. The trim piece may have a thinner construction than the panel, and is configured to rest between a troffer flange of a troffer and a T-track. The trim piece may be formed of four segments riveted to one another in a substantially square shape. Alternatively, the trim piece may be formed of two pairs of segments, where each pair of segments is riveted together, and the two pair interconnect with each other using a tab and slot connection.

These and other aspects of the present disclosure are described in greater detail below and shown in the drawings.

BRIEF DESCRIPTION OF THE DRAWINGS

Various aspects of the present disclosure are described herein below with reference to the drawings, which are incorporated in and constitute a part of this specification, wherein:

FIG. 6 depicts a simplified view of the retro-fit panel of FIG. 5;

DETAILED DESCRIPTION

The present disclosure relates generally to retro-fit assembly and kit that may be installed without having to remove the previously installed fluorescent light troffers. Further, the retro-fit assembly can be quickly installed substantially without the use of tools, and with reduced risk of falling from ladders and the like.

Prior to the installation of a retro-fit assembly of the present disclosure, any lens or cover on the existing light panel may be removed from the ceiling grid to expose the fluorescent lights. The lights may be removed and disposed of and the electrical connection of the electrical mains to a ballast typically used in fluorescent lighting severed. The troffer, and indeed the ballast and now severed wires may remain in place and removal of the troffer is not necessary for use of the present retro-fit assembly. Indeed, a major benefit of the retro-fit assembly of the present disclosure is the elimination of the need to access and remove the ballast, starter and other electrical components of the existing lighting system.

Figure 1:
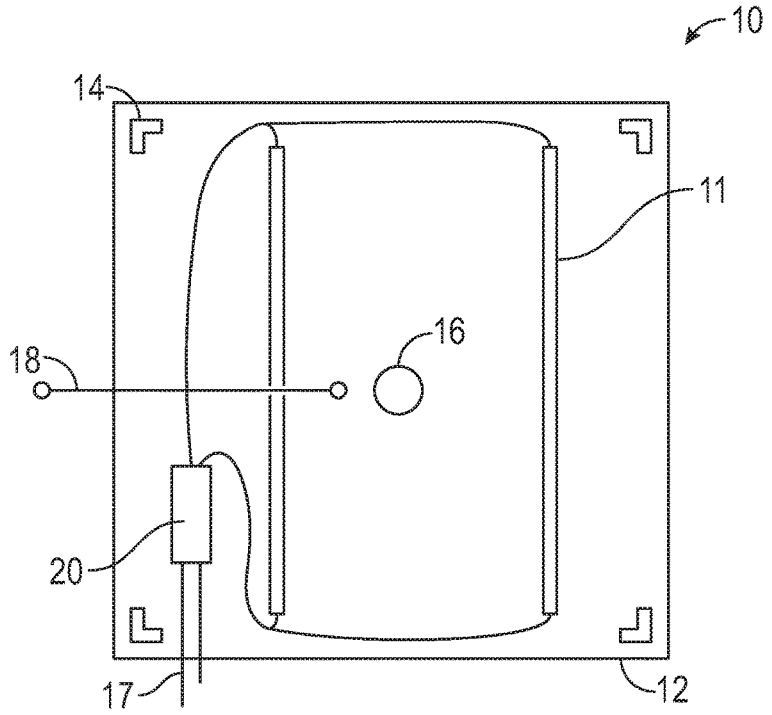
FIG. 1 depicts a top view of a retro-fit panel in accordance with one aspect of the present disclosure.

FIG. 1 depicts a top view of a light retrofit assembly 10 including an LED panel 12. The LED panel 12 may be formed of one or more sheets of clear or translucent material having one or more LED strips 11 imbedded or adhered to the panel 12. As shown two LED strips 11 are arranged on the panel 12 and connected in parallel with a driver 20 that is to be electrically connected to electrical mains 17 to power the LEDs. As will be appreciated, nearly any design of LEDs, including a single strip, shaped strips including circles, oblongs, horseshoe, and others may be employed without departing from the scope of the present disclosure.

The panel 12 may include both top and bottom sheets (described below) and may have the LED strips sandwiched there between, with the strips adhered to a downward facing side of a top sheet and the light produced passing through a bottom sheet. This arrangement hides from sight the LED strips 11 and allows for the bottom sheet to act as a diffuser or lens to spread or modulate the produced light into an aesthetically pleasing luminosity and color.

Figure 2:
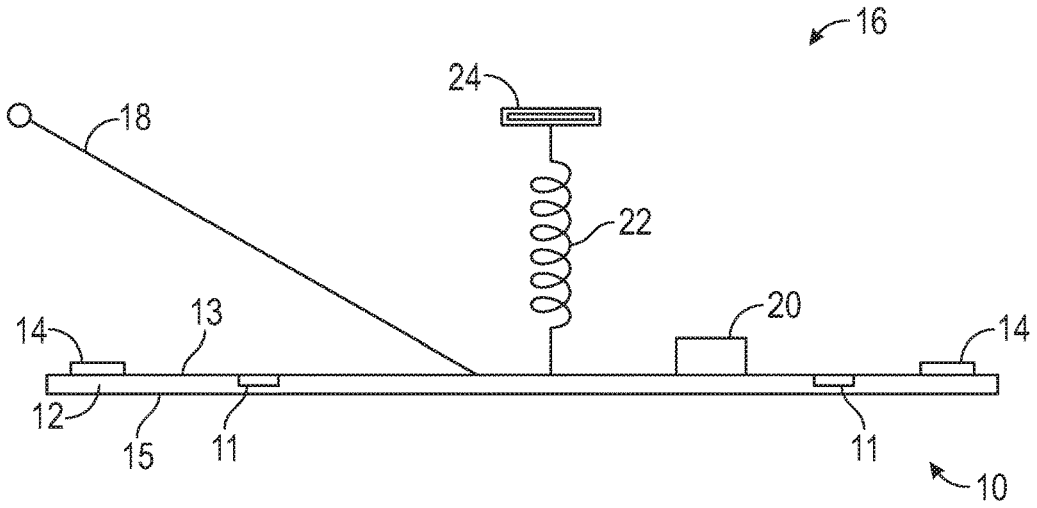
FIG. 2 depicts a side view of the retro-fit panel of FIG. 1.

Alignment blocks 14 may be utilized to align the panel 12 in a troffer, particularly those that are installed in drop ceilings in which a T-track is used as is common in most commercial and some residential applications to form a ceiling grid and will be explained in greater detail below. An extendible suspension device 16 is secured to the panel 12 and is used to quickly and efficiently secure the panel 12 to a troffer. In one embodiment described below, the suspension device 16 is formed of a spring 22 and a magnet 24 (FIG. 2). The spring 22 allows for the panel 12 to be pulled away from a troffer for the purposes of securing the electrical mains 17 to the LED driver 20. The magnet 24 allows for the tool-less connection of the retro-fit assembly 10 to the troffer. Once the magnet 24 is placed on the troffer, and the electrical mains 17 are connected to the driver 20, the panel 12 may be aligned with the troffer and the spring 22 will draw the panel 12 firmly against the T-tracks (see FIG. 4) and the alignment blocks 14 will properly align the panel 12 with the troffer. If necessary for local building codes or for peace of mind for business owners looking to have these retro-fit assemblies 10 installed, a safety cable 18 may be incorporated and secured to the panel 12. The safety cable 18 may be secured to the troffer with a single self-tapping screw. This may be installed after the magnet 24 has been attached to the troffer, permitting the installer to have both hands free for use of tools and to reduce the likelihood of a fall by eliminating the need to hold the retro-fit assembly 10 while securing the screw for the safety cable 18.

Figure 3:
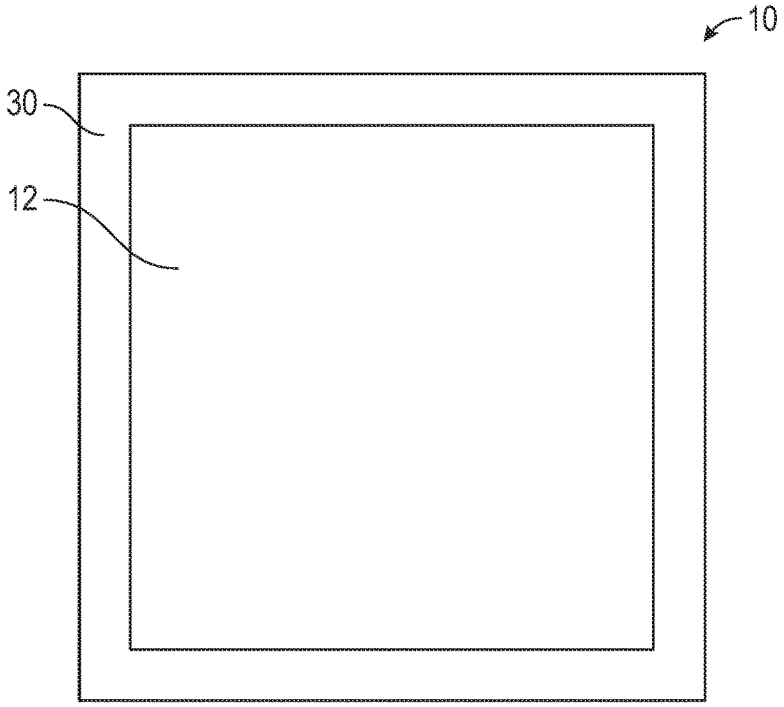
FIG. 3 depicts a bottom view of a retro-fit panel of FIG. 1 as installed.

FIG. 2 depicts a side view of the retro-fit assembly 10. As depicted in FIG. 2, the LED strips 11 are adhered to a bottom facing side of a top sheet 13 of panel 12, and project light in the direction of bottom sheet 15. In such an arrangement the opacity or translucence of bottom sheet 15 can be selected to prevent the LED strips 11 from being visible. Further, the bottom facing side of top sheet 13 may have a color such as white to both promote the reflection of light produced by the LEDs back towards the bottom sheet 15 and to make the top sheet 13 sufficiently opaque that the driver 20 mounted thereon, and other internal components (e.g., alignment blocks 14, spring 22, magnet 24) cannot be seen. FIG. 3 depicts the retro-fit assembly 10 as viewed from below. As can be seen the panel 12 rests against the T-track 30, and all the componentry of the retro-fit assembly 10 other than the panel are hidden from view.

Figure 4:
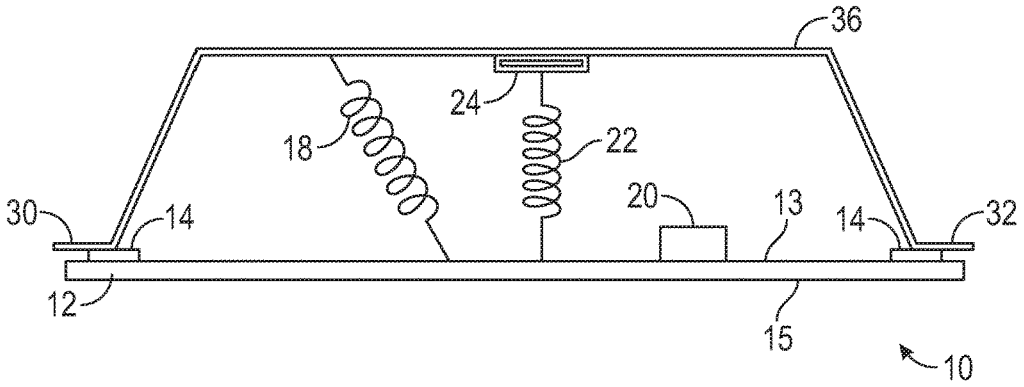
FIG. 4 depicts a side view of a retro-fit panel of FIG. 1 as installed.

FIG. 4 depicts a side view of a retro-fit assembly 10 as installed in a troffer 36 and against T-track 30. The troffer, as is common rests on a horizontal portion 32 of the T-track. Though not shown the troffer may also be secured to other features, though it is not uncommon for the troffer to simply rest on the horizontal portion 32 of the T-track 30. As can be seen the alignment blocks 14 rests against a horizontal portion 32 of the T-track 30 to ensure that the retro-fit assembly 10 is properly placed within the troffer and aligned with the T-tracks. The panel 12 also rests against the horizontal portion 32 and prevents the panel 12 from being pulled into the troffer 36 by the spring 22. As shown the safety cable 18 is formed of a material that forms a coil when not under tension, however, a simple wire cable may also be employed.

FIG. 4 depicts one embodiment of the present disclosure, for some applications, the panel resting on the bottom surface of the horizontal portion 32 of the T-track may present an aesthetically unappealing arrangement. Further in some applications the lighting arrangement may form part of an airflow pathway and may need to be better sealed to prevent airflow out of the airflow pathway. Similarly, in some applications separation of the electrical components (e.g., driver 20, LEDs 11, and electrical mains 17) may be necessitated because of the presence of aerosolized particles and droplets in the environment in which the lighting is employed. To address these concerns a second embodiment of the present disclosure may be employed.

Figure 5:
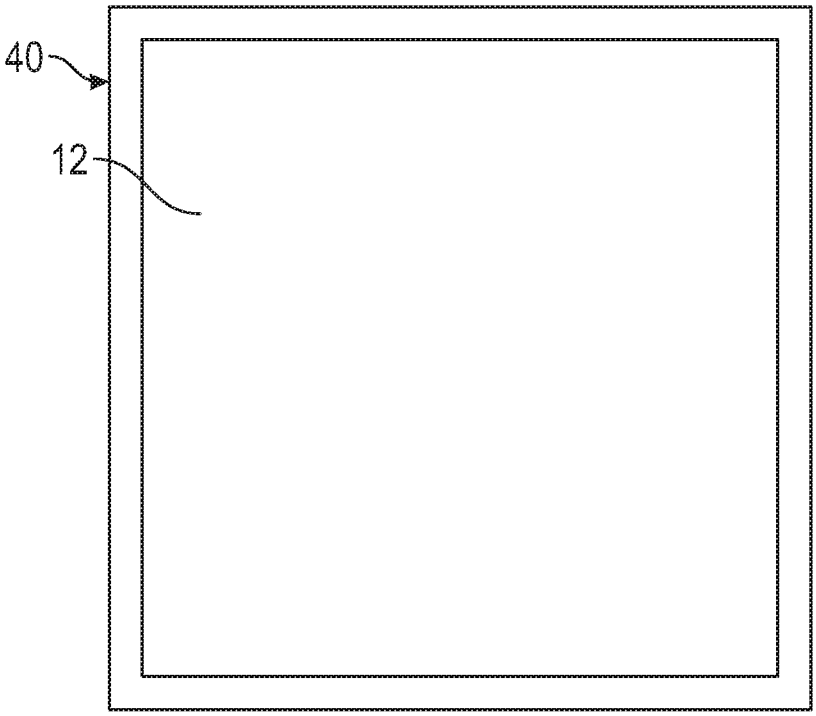
FIG. 5 depicts a bottom view of a further embodiment of a retro-fit panel.
Figure 7:
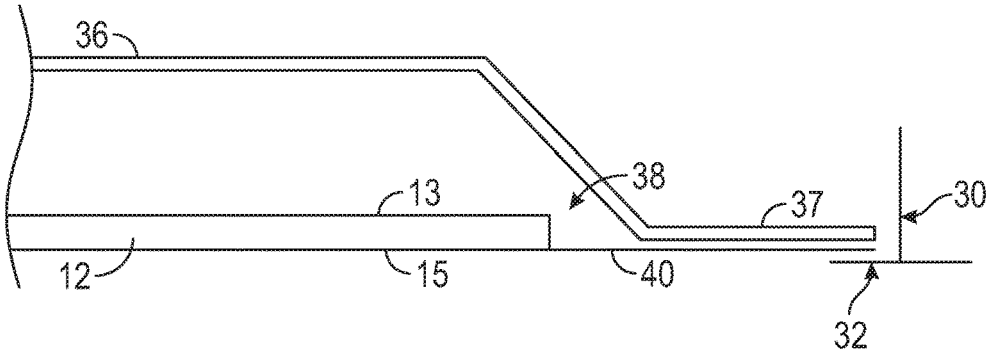
FIG. 7 depicts a magnified view of a portion of the retro-fit panel of FIG. 6.

FIG. 5 depicts a second embodiment of the present disclosure in which a trim piece 40 is employed along with panel 12. The trim piece 40 is formed of a thin material and forms a shape that conforms to the shape of the panel 12. FIG. 6 depicts how the panel 12 and trim piece 40 may be deployed. The panel 12 is sized slightly smaller than the dimensions of the panel 12 depicted in, for example, FIG. 4. The panel 12 rests on the trim piece 40 and trim piece 40 suspends the panel 12 in the T-track 30. FIG. 7 provides greater detail of the interaction of the trim piece 40 with the T-track 30. As can be seen, by reducing the dimension of the panel 12 a clearance 38 is achieved with respect to the troffer 36. The trim piece 40 extends from the panel 12 it supports and rests on a top surface of the horizontal portion 32 of the T-track 30 and beneath a flange 37 of the troffer 36. The flange 37 helps hold the trim piece 40 on the T-track 30.

Figure 8:
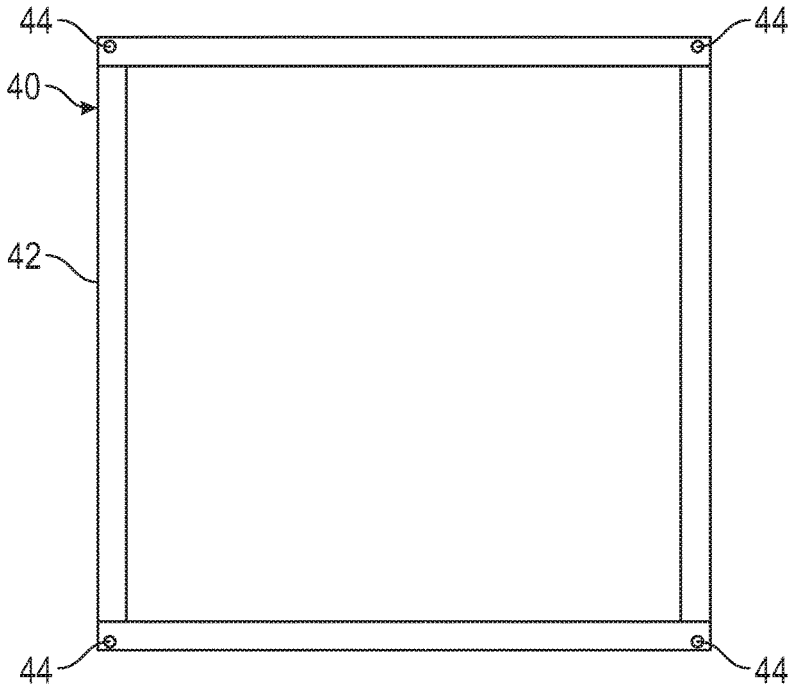
FIG. 8 depicts a trim section for use with retro-fit panels of the present disclosure.
Figure 9:
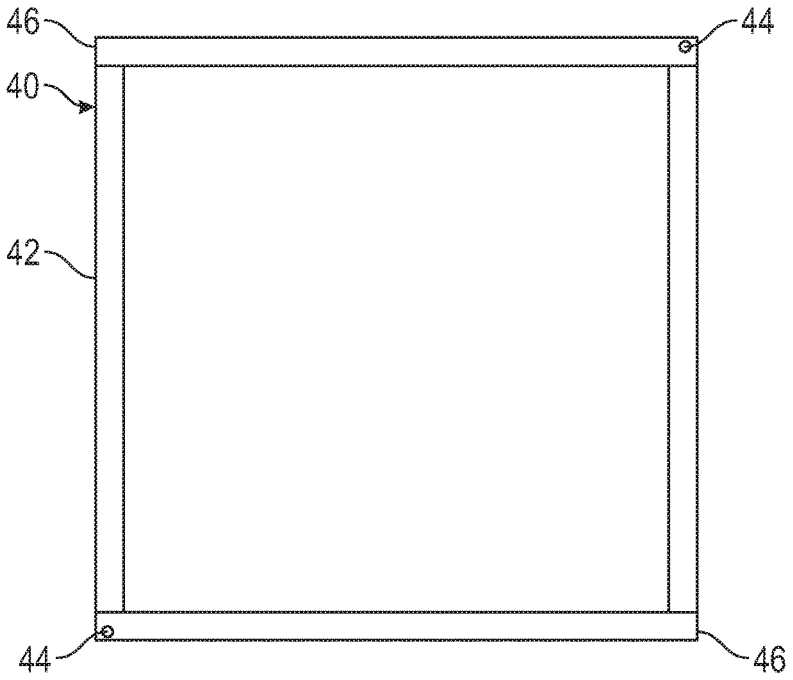
FIG. 9 depicts a further trim section for use with retro-fit panels of the present disclosure.

To permit the trim piece 40 to be installed into the T-tracks 30 of a ceiling grid the trim piece 40 may be manufactured four separate pieces 42 (e.g., slats) having a dimension to span the distance from the T-track 30 to the panel 12. The pieces are formed into a square and held together by rivets 44, as shown in FIG. 8. The rivets 44 are an economical attachment mechanism that permit articulation of the pieces 42. Other attachment means (e.g., screws and bolts) may be employed without departing from the scope of the present disclosure. In this way, when two opposing corners of the trim piece 40 are pressed toward each other, the trim piece 40 deforms into a diamond shape and may be inserted into a ceiling opening formed by T-bars 30 of the ceiling grid, as depicted in FIG. 7. Prior to insertion, the panel 12 may be attached to the troffer 36 using magnet 24 and the driver 20 connected to the electrical mains 17. Because of clearance 38, the panel 12 may be pushed into the troffer 36 enabling the insertion of the trim piece 40 between the troffer flange 37 and the horizontal portion 32 of the T-track 30, thereby supporting the panel. In another embodiment, as shown in FIG. 9, the trim piece may be formed of two pairs of separate pieces 42, where each is are riveted together to form sub-assemblies that can be folded and easily placed on the horizontal portions 32 of the T-track 30. In a further embodiment the free ends of one of the sub-assemblies may be configured to mate with the free ends of the other one of the sub-assemblies using a tab and slot or other non-permanent sheet metal attachment configuration. Both of the sub-assemblies may be inserted into the ceiling opening and the orientations of one or both are manipulated in order to couple the two together. Alternatively, or additionally the trim piece 40 and panel 12 as well as trim piece 40 and T-track 30 may magnetically or slidingly secure to one another to allow easy installation and adjustment. As noted above, the panel 12 may be attached to the troffer 36 first, and the trim piece 40 subsequently installed.

Figure 10:
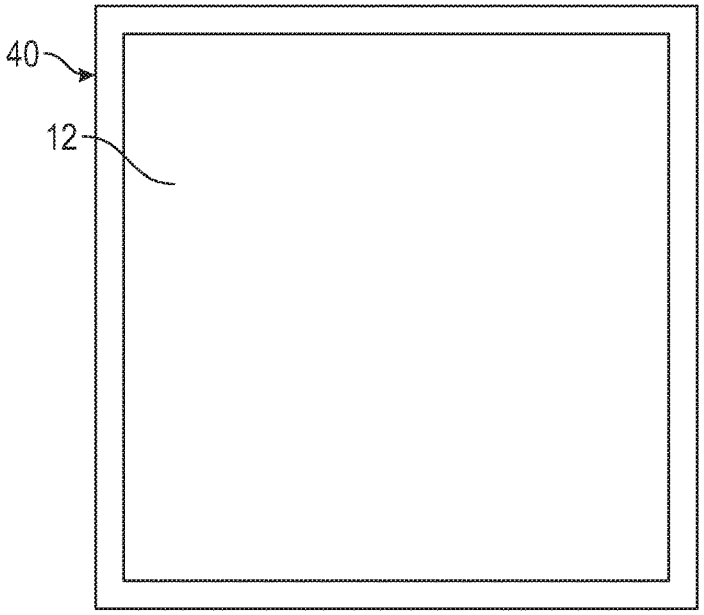
FIG. 10 depicts a bottom view of a retro-fit panel in accordance with a further embodiment of the disclosure.

In still another embodiment, as shown in FIG. 10, the trim piece 40 may be molded from a flexible plastic or other material, but is capable of returning to an original configuration. Specifically, the flexible plastic is selected such that it elastically deforms as necessary to allow for insertion into the T-track 30 of the ceiling grid, but also has sufficient memory to return to substantially its original shape and further has sufficient rigidity to support the panel 12. In some embodiments this flexible plastic trim piece may be integrally formed with the panel. For example, referring to FIG. 4 or 7, the bottom sheet 15 may be completely formed of the flexible material allowing for one-piece construction of the trim piece 40 and panel 12. Alternatively, the bottom sheet 15 may be formed of multiple materials to achieve the above-identified purposes of the panel 12 and the trim piece 40.

The panel 12 may be sized for installing into troffers having 600 mm×600 mm dimensions. In some instances that may require the panel 12 to have dimensions of 540 mm×540 mm for use with trim piece 40 having a nominal 30 mm width on each side. It will be appreciated that the particular dimensions of the panel 12 and trim piece 40 may be customized to fit other size light panels or troffers without departing from the scope of the present disclosure.

Although the present disclosure has been described with reference to specific exemplary embodiments, it is obvious to the person skilled in the art that different modifications may be carried out and equivalents used as replacements without departing from the scope of the present disclosure. As a result, the present disclosure is not intended to be limited to the disclosed exemplary embodiments but is intended to encompass all exemplary embodiments which fall within the scope of the accompanying claims. In particular, the present disclosure also claims protection for the subject and features of the sub-claims independently of the claims referred to.

We claim:

1. A lighting retro-fit assembly comprising:

a panel configured for passage of light therethrough, the panel including a top sheet and a bottom sheet;

at least one light emitting diode (LED) sandwiched between the top sheet and the bottom sheet of the panel, the at least one LED secured to a downward facing side of the top sheet such that light produced is projected through the bottom sheet;

a driver electrically connected to the at least one LED;

an extendible suspension device secured to the panel, wherein the extendible suspension device permits mechanical connection of the panel to an existing lighting structure while enabling access to the driver; and a trim piece formed of four segments riveted to one another in a substantially square shape, wherein the panel rests on the trim piece upon installation, and wherein two opposing corners of the trim piece are configured to deform into a diamond shape for insertion into a ceiling opening in a ceiling grid.

2. The lighting retro-fit assembly of claim 1, further comprising at least one alignment block.

3. The lighting retro-fit assembly of claim 1, wherein the extendible suspension device includes a magnet and a spring.

4. The lighting retro-fit assembly of claim 1, wherein the trim piece is a flexible trim piece that deforms elastically to enable insertion of the flexible trim piece between a troffer flange of a troffer and a T-track, the trim piece having sufficient rigidity to support the panel following installation.

5. The lighting retro-fit assembly of claim 1, wherein the trim piece has a thinner construction than the panel, and is configured to rest between a troffer flange of a troffer and a T-track.

6. The lighting retro-fit assembly of claim 1, wherein the trim piece is formed of four segments riveted to one another in a substantially square shape.

7. The lighting retro-fit assembly of claim 1, wherein the trim piece is formed of two pairs of segments, each pair of segments is riveted together, and the two pairs interconnect with each other using a tab and slot connection.

8. The lighting retro-fit assembly of claim 3, wherein a first end of the spring is secured to an upward facing side of the top sheet of the panel and a second end of the spring is secured to the magnet.

9. The lighting retro-fit assembly of claim 8, wherein the driver is secured to the upward facing side of the top sheet of the panel.

10. The lighting retro-fit assembly of claim 9, further comprising at least one alignment block positioned on the upward facing side of the top sheet of the panel.

11. A lighting retro-fit assembly comprising:

a panel configured for passage of light therethrough, the panel including a top sheet and a bottom sheet;

at least one light emitting diode (LED) sandwiched between the top sheet and the bottom sheet of the panel, the at least one LED secured to a downward facing side of the top sheet such that light produced is projected through the bottom sheet;

a driver electrically connected to the at least one LED; and an extendible suspension device secured to the panel, wherein the extendible suspension device permits mechanical connection of the panel to an existing lighting structure while enabling access to the driver, wherein the extendible suspension device includes a magnet and a spring, and wherein a first end of the spring is secured to an upward facing side of the top sheet of the panel and a second end of the spring is secured to the magnet.

12. The lighting retro-fit assembly of claim 11, wherein the driver is secured to the upward facing side of the top sheet of the panel.

13. The lighting retro-fit assembly of claim 11, further comprising at least one alignment block.

14. The lighting retro-fit assembly of claim 13, wherein the at least one alignment block is positioned on the upward facing side of the top sheet of the panel.

15. A lighting retro-fit assembly comprising:

a panel configured for passage of light therethrough, the panel including a top sheet and a bottom sheet;

at least one light emitting diode (LED) sandwiched between the top sheet and the bottom sheet of the panel, the at least one LED secured to a downward facing side of the top sheet such that light produced is projected through the bottom sheet;

a driver electrically connected to the at least one LED; and a suspension device secured to the panel, wherein the suspension device permits mechanical connection of the panel to an existing lighting structure while enabling access to the driver, wherein the suspension device includes a magnet and an extendible cable, and wherein a first end of the extendible cable is secured to an upward facing side of the top sheet of the panel and a second end of the extendible cable is secured to the magnet.

16. The lighting retro-fit assembly of claim 15, wherein the driver is secured to the upward facing side of the top sheet of the panel.

17. The lighting retro-fit assembly of claim 15, further comprising at least one alignment block.

18. The lighting retro-fit assembly of claim 17, wherein the at least one alignment block is positioned on the upward facing side of the top sheet of the panel.

* * * * *